United States Patent [19]

Hait

[11] 4,445,248

[45] May 1, 1984

[54] ROTARY STRIPPER

[75] Inventor: James M. Hait, San Jose, Calif.

[73] Assignee: International Hardware, Inc., Bridgewater, N.J.

[21] Appl. No.: 384,978

[22] Filed: Jun. 4, 1982

[51] Int. Cl.[3] ..... A46D 9/02; A46B 7/10; A47L 13/08

[52] U.S. Cl. ..... 15/198; 15/236 C; 29/81 J

[58] Field of Search ..... 15/179, 197, 198, 200, 15/93 R, 104.14; 29/81 H, 81 J; 51/336, 337; 144/115; 17/64, 67; 125/5; 30/172, 276

[56] References Cited

U.S. PATENT DOCUMENTS

| | | | |
|---|---|---|---|
| 1,615,134 | 1/1927 | Price | 17/64 |
| 1,694,018 | 12/1928 | Mudge et al. | 17/64 |
| 2,763,257 | 9/1956 | Asbury | 125/5 |
| 2,962,745 | 12/1960 | Pederson | 15/198 |
| 4,106,193 | 8/1978 | Fisher et al. | 15/236 C |
| 4,200,947 | 5/1980 | Ali | 15/198 |
| 4,324,017 | 4/1982 | Viehe | 15/198 |

*Primary Examiner*—Peter Feldman
*Attorney, Agent, or Firm*—Jacob B. Burks

[57] ABSTRACT

This rotary stripper is provided with a cylindrical housing rotatable in one direction. The housing has a plurality of peripheral wall openings through which project arms of flexible blades. Each blade has a longer work engaging flexing arm, and a shorter reaction arm which intercepts a longer flexing arm as it rebounds forwardly from the work. Both arms may project through the same wall opening to confront each other. Alternatively the longer arm may project through one wall opening while the reaction arm projects through the next trailing wall opening to confront the longer arm of the next trailing blade. Each wall opening has a curved abutment surface at the trailing side of each longer arm in the opening. This surface is contacted by the longer arm as it ends rearwardly during contact with the work. The abutment surfaces and the reaction arms are contoured to limit the range of stresses set up in the longer arms as they flex and rebound, to a range which will avoid producing fatigue failure in the longer arms, thus lenthening their useful lives.

15 Claims, 10 Drawing Figures

ROTARY STRIPPER

BACKGROUND OF THE INVENTION

Rotary strippers in which metal blades or wires move rapidly in a rotary path so that their outer free ends can be brought into contact with the surface of a workpiece to impact against a substance thereon, such as a layer of paint, rust, or the like, and remove the substance from the surface have received fairly wide acceptance. Several arrangements of stripping blades have been proposed and, while some have been fairly well received, the breaking of blades due to fatigue failures is a consideration that must be addressed by the designer of such tools.

In a pending application of John S. Viehe, Ser. No. 281,096, now U.S. Pat. No. 4,377,412, which is assigned to the assignee of the present invention, an insert in the form of a spring clip is positioned between each blade and the housing in which the blade flexes. Each insert is provided with two arms, one of which is disposed on the trailing side of a blade and the other of which is disposed on the leading side of the blade. The arm on the trailing side of the blade is adapted to yieldingly resist the rearward movement of the blade as it flexes rearwardly when it contacts a workpiece, and the clip arm on leading side of the blade resiliently cushions the forward rebound movement of the blade. This arrangement has been somewhat successful in reducing blade breakage. However, since the assembly of one of these tools involves the positioning of many individual blades, depending upon the size and purpose of the tool, the insertion of clips in addition to the positioning of the blades results in additional assembly time. Also, the production of these clips involves costs which increase the total cost of producing a tool having such clips. In an application of John S. Viehe, Ser. No. 187,714, now U.S. Pat. No. 4,324,017, is disclosed a housing for spring blades, the housing having curved surfaces on both the leading and trailing sides of each slot holding each blade.

It is an object of the present invention to provide a rotary stripper having means for keeping the stresses set up in the blades during flexing within ranges that will not result in fatigue failure of the blades. Particularly it is an object of the invention to provide, in the blade-retaining housing itself, surfaces against which the blades can impact without excessive stresses being set up in the blades.

Another object is to provide a blade having a leading and a trailing arm, the leading arm being curved to provide a surface which controls the stress set up in the trailing arm when the trailing arm contacts the leading arm during its forward rebound movement.

Another object of the invention is to provide an improved housing construction, and improved drive arrangements for a rotary stripper.

SUMMARY OF THE INVENTION

A rotary stripper has a housing with a plurality of openings in the periphery of a generally cylindrical wall. At least one blade projects outwardly through each opening, and the wall of the housing on the trailing side of blade is contoured so that the stress set up in the rearwardly flexing blade arm as it contacts the contoured surface is maintained in a range that will permit repeated flexing of the blade without fatigue failure. An arm, that is formed integrally with the flexing blade arm, is disposed on the leading side of the flexing arm and is contoured to limit the stress set up in the blade at the end of its forward movement.

DESCRIPTION OF PREFERRED EMBODIMENT

Figure 1:
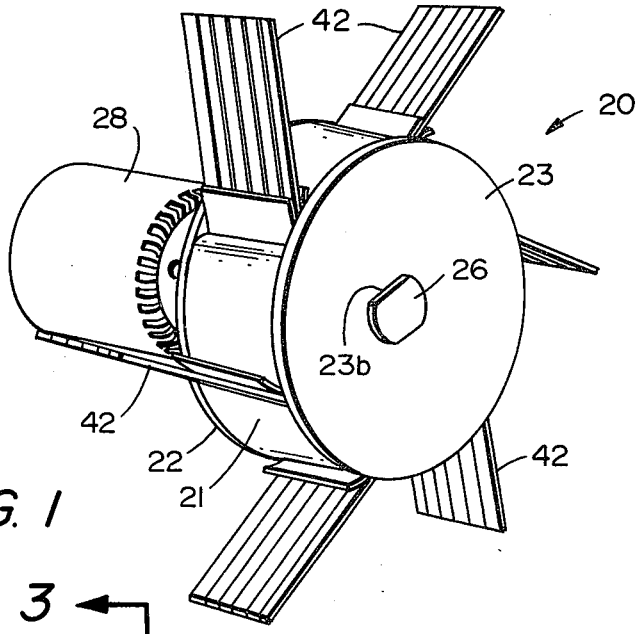
FIG. 1 is a diagrammatic perspective of a rotary stripper constructed in accordance with the teachings of the present invention.
Figure 2:
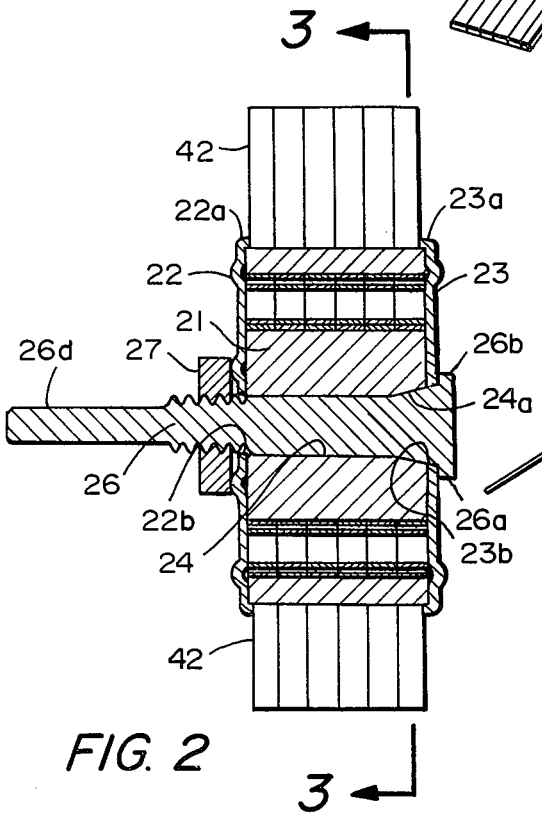
FIG. 2 is a diagrammatic section taken along the longitudinal centerline of the tool of FIG. 1.
Figure 3:
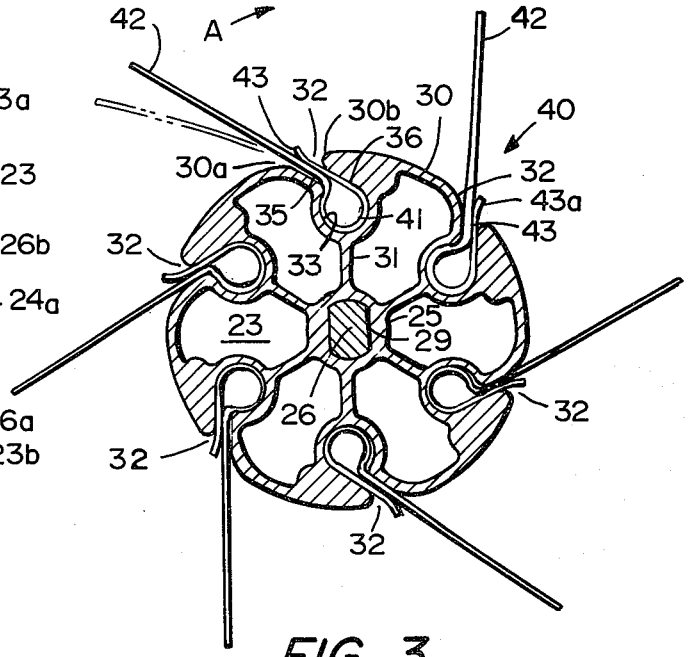
FIG. 3 is a section taken along line 3—3 of FIG. 2.
Figure 4:
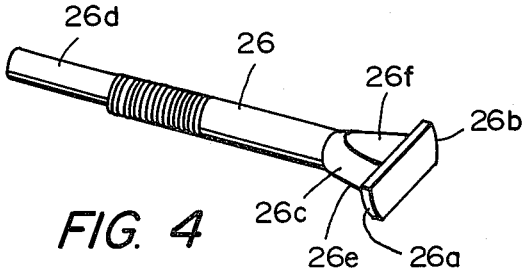
FIG. 4 is a diagrammatic perspective of the drive shaft used in the stripper of FIG. 2.

In FIGS. 1 and 2, the reference numeral 20 indicates generally a rotary stripper which includes a central body member 21 and two end plates 22 and 23. The end plates have peripheral flanges 22*a* and 23*a*, respectively, that are inturned to overlie the outer, generally cylindrical edges of the body member 21. A cylindrical passage 24, that has an outwardly tapered end section 24*a*, extends axially through a central hub 25 (FIG. 3) of the body member in alignment with a circular opening 22*b* in plate 22 and an oblong opening 23*b* (FIG. 1) in the end plate 23. A shaft 26 extends through the three aligned passages to receive a nut 27 which is threaded on the shaft in an angular direction such that it will not loosen on the shaft when the shaft is rotated in the direction of arrow A (FIG. 3). When the nut is screwed down on the shaft, the body member and the end plates become locked between the nut and flanges 26*a* and 26*b* (FIG. 4) formed on a tapered end section 26*c* of the shaft to form a unitary structure. The shaft has a reduced diameter end section 26*d* adapted to be received in the chuck 28 (FIG. 1) of a power tool. As seen in FIG. 4, the tapered end 26*c* of shaft 26 has two flat side walls 26*e* and 26*f* which are adapted to engage a pair of flat walls 29 formed on opposite sides of a tapered section 24*a* of the hub. The flat walls of the shaft also engage the sides of the oblong opening 23*b* in the end plate 23.

The body member 21 has a generally cylindrical outer wall 30 (FIG. 3) joined to the hub 25 by a plurality of radially projecting flanges 31 that are spaced equi-angularly around the hub. The peripheral wall 30 is interrupted at equi-angularly spaced areas to provide a plurality of exit openings 32. Each opening 32 communicates with a generally cylindrical socket 33 by means of a passage defined between wall members 35 and 36.

A plurality of stripping blades 40 are carried by the central body member 21, each blade having a generally cylindrical section 41 disposed in one of the sockets 33, and arm members 42 and 43 extending in side-by-side relation through the adjacent passage between walls 35 and 36. Each blade is an elongate flat strip member made of metallic spring material, and all blades for a particular rotary stripper are identical in dimensions and configuration. Blades of different dimensions may be furnished for different types of working operations and they may vary over a wide range, as for example, from a width of 1/16 of an inch to ¼ of an inch and from a thickness of 0.050 inches to about 0.018 inches. The blade arm 42, which is on the trailing side of arm 43, is a relatively straight member that is longer than the arm 43 which has a curved outer end portion 43*a*.

When the tool is rotated clockwise (FIG. 3) as indicated by arrow A, the end of each blade arm 42 contacts the work surface and if flexed back toward a position, indicated in phantom lines in FIG. 3, in contact with a smoothly curved portion 30*a* of the peripheral wall that adjoins the wall 35. Wall portion 30*a* is normally curved to conform to the desired configuration of the blade arm in its bent-back, phantom-line position so that no excessive bending stresses are imposed on the blade at its point of maximum curvature due to its contact and support by the wall surface 35. If desired, this curvature may be varied to impart other desired flexing characteristics to the blade and to control stress concentrations during the flexing action.

After being flexed counterclockwise during contact with the work surface, the blade arm 42 snaps back and engages the curved end section 43*a* of arm 43. This end section curves in an arc away from the arm 42 so that, as arm 42 flexes after impinging on arm 43, its curvature is likewise controlled by the curvature and support provided by section 43*a*. In this manner the bending stress in the arm 42 is gradually absorbed within limits of possible fatigue failure of the arm itself.

To assemble the rotary stripper 20, the shaft 26 is inserted through the end plate 23, and the flat walls 26*e* and 26*f* are positioned in driving engagement with the sides of oblong opening 23*b* in end plate 23 and with the flat walls 29 of the tapered section 24*a*. The subassembly is then positioned open-end-up as seen in FIG. 3, and the stripping blades are dropped into place. After all the blades are in place, the end plate 22 is positioned over the shaft 26 and the nut 27 threaded down onto the shaft until it abuts the outer surface of end plate 22.

Figure 5:
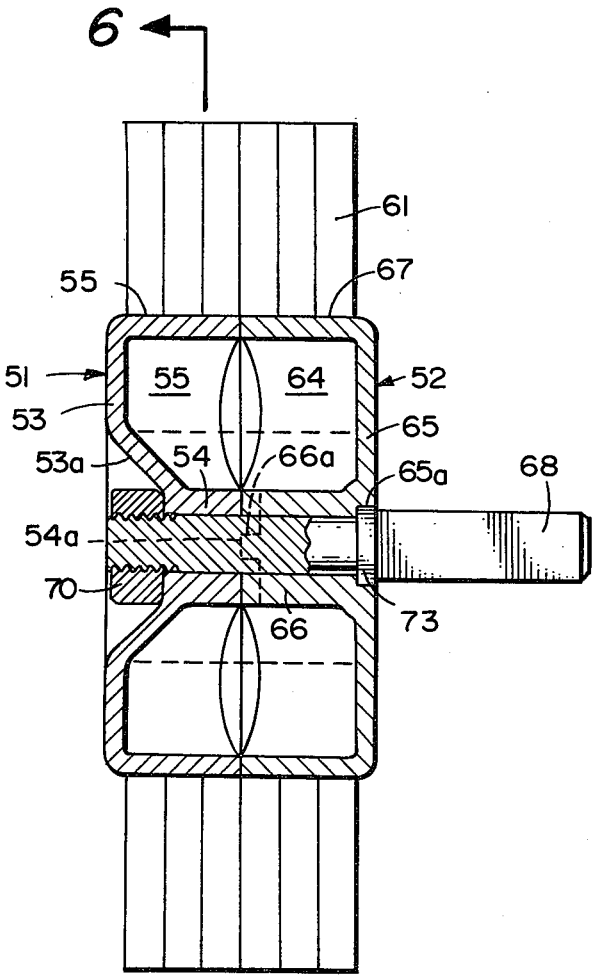
FIG. 5 is a diagrammatic section taken longitudinally along the centerline of a second embodiment of the present invention, parts being shown in elevation.
Figure 6:
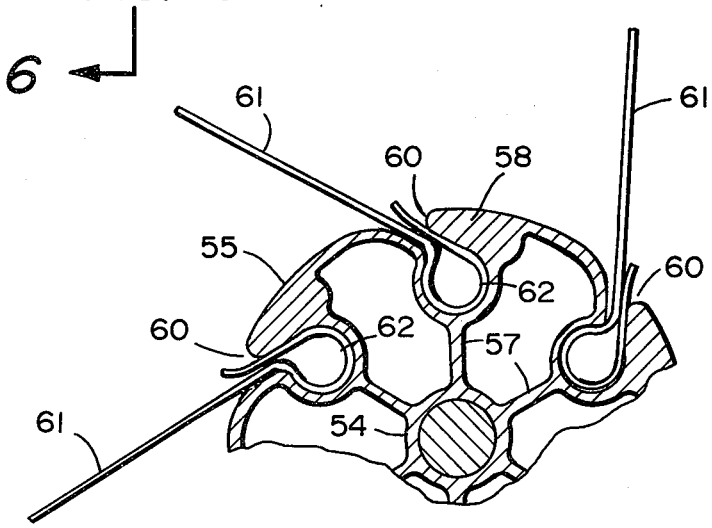
FIG. 6 is a fragmentary diagrammatic section taken along line 6—6 of FIG. 5.

In FIGS. 5 and 6 another embodiment of the stripping tool of the present invention is illustrated which features a unique housing made up of two sections 51 and 52. Section 51 comprises an end wall 53 integrally formed with a blade-holding body 55. The body is generally identical in configuration to the body member 21 of FIGS. 1–3 and includes a hub 54 and a plurality of radially-extending webs 57 (FIG. 6) which connect the hub 54 to a peripheral wall 58 of the body 55. A plurality of exit openings 60 in the peripheral wall receive blades 61 that have curled inner ends disposed in generally cylindrical sockets 62 in the body. The blades 61 are identical to the blades 40 of FIG. 3 and operate in the same manner, and the portions of the peripheral wall on each side of each exit opening 60 are identical in configuration to the corresponding parts of FIG. 3.

Housing member 52 comprises an end wall 65 formed integrally with a body member 64 that has a tubular hub 66 and a peripheral wall 67. The hub 66 and the body member 64 are substantially identical to the hub 54 and the body member 55 of housing section 51 but are mirror images of those parts so that, when the sections 51 and 52 are positioned in abutting relation as illustrated in FIG. 5, the corresponding parts of the two sections may be aligned to position the blades 61 in one section in alignment with the blades 61 in the other section. Also, the end walls 65 and 53 differ somewhat in that the wall 53 is provided with a deep recess 53*a* near its center while the wall 65 is provided with a relatively small socket 65*a* of square or hexagonal cross-section near its center.

The hub 54 is provided with a plurality of notches 54*a* that are adapted to receive short drive arms 66*a* on the hub 66 in driven engagement. A drive shaft 68, which extends through the aligned hubs, has a cylindrical section at one end adapted to be received in the chuck of a power tool and, at its other end, has a threaded section which receives a nut 70 thereon. A square or hexagonal head 73, that is formed on the drive shaft 68, is disposed in driving relation in the socket 65*a* in the end wall 65. Thus, when the two-piece housing is assembled in the manner shown in FIG. 5, the shaft 68 drives the housing section 52 due to the engagement of the driving head 73 in the socket 65*a*, and housing section 52 in turn drives the housing section 51 through the engagement of the drive arms 66*a* with the walls of the notches 54*a*.

Figure 7:
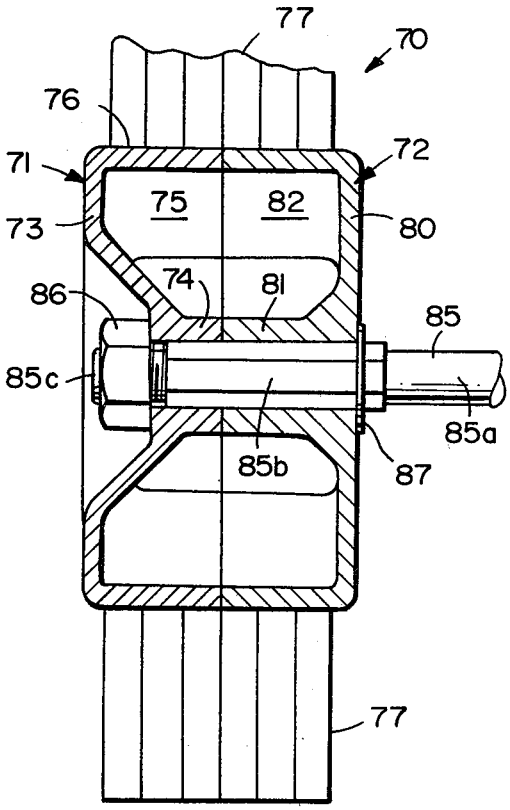
FIG. 7 is a diagrammatic section taken along the longitudinal centerline of a third embodiment of the invention.

In FIG. 7 a further embodiment 70 of the rotary stripper of the present invention is illustrated which features an advantageous drive arrangement. The stripper 70 includes a housing made up of two sections 71 and 72. Section 71 is substantially identical to section 51 of FIGS. 5 and 6, having an end wall 73 integrally formed with a blade holding body 75. The body 75 is substantially identical to the body 55 of FIG. 6, having a short tubular hub 74 and a periheral wall 76 that provides a plurality of angularly-spaced exit openings through which blades 77 project. The hub 74 does not, of course, have notches similar to notches 54*a*. The blades have the same configuration as the blades 61 of FIG. 6 and have inner curled ends disposed in sockets in the body 75.

Similarly, housing section 72 is substantially identical to the housing section 52 of FIGS. 5 and 6, having an end wall 80 integrally formed with a blade-holding body member 82 that includes a short tubular hub 81. The body 82 is substantially identical to the body 67 of FIG. 5 in that it is a mirror image of body 75 and includes an outer peripheral member which provides a plurality of sockets for retaining the curled inner ends of the blades.

The hubs 74 and 81 differ from the hubs 54 and 66 in that the hubs 74 and 81 do not have notches and drive arms and the aligned central passages of hubs 74 and 81 may be hexagonal, square, or splined in cross-section. A drive shaft 85 includes a cylindrical section 85*a* adapted to be received in the chuck of a rotary power tool, and a section 85*b* which has a cross-section corresponding to the cross-section of the central passages of hubs 74 and 81. Section 85*b* is disposed in driving engagement in the composite longitudinal opening provided by the hubs. A nut 86 is threaded on an end 85*c* of shaft 85 and is arranged to be threaded down against the face of wall 73 to draw the shaft into the housing until a snap ring 87, that is disposed in a slot (not shown) in the periphery of the shaft, abuts against the outer face of end wall 80. It will be evident that rotation of shaft 85 imparts a direct, positive driving impulse to both housing sections 71 and 72 to rotate the housing.

Figure 8:
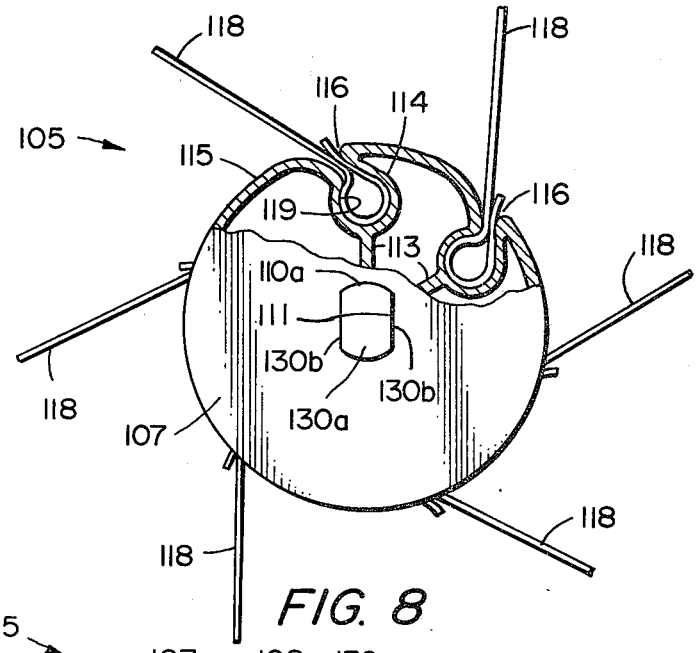
FIG. 8 is a diagrammatic end elevation, with parts broken away, of a fourth embodiment of the rotary stripper of the present invention.
Figure 9:
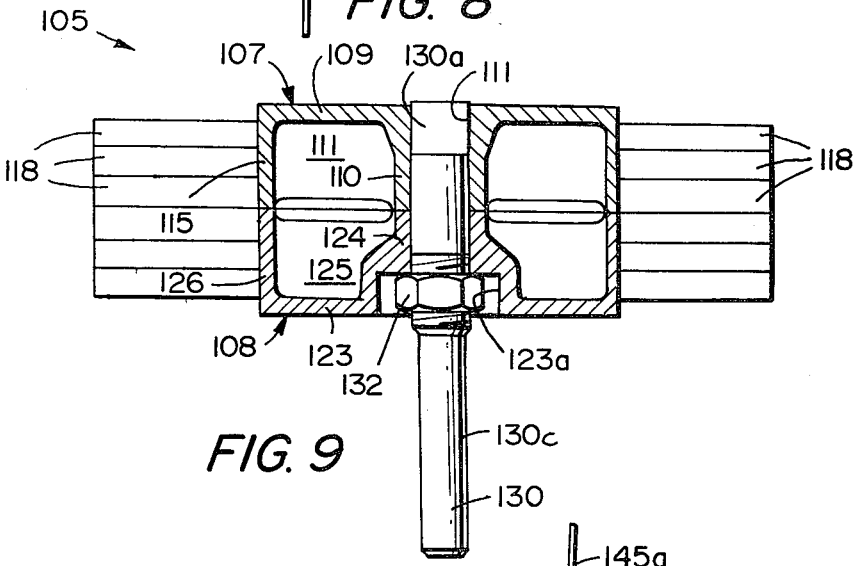
FIG. 9 is a diagrammatic section taken along the longitudinal centerline of FIG. 8.

In FIGS. 8 and 9 the reference numeral 105 indicates generally an embodiment of the rotary stripper which features a construction that permits the chuck of the rotary power tool to engage the drive shaft of the stripper at a point close to the housing so that any tendency of the stripper to whip relative to the power tool during operation is minimized. The housing of the stripper is made up of two sections 107 and 108. Section 107 comprises an end wall 109 integrally formed with a body member 111. Body member 111 is substantially identical to the body member 21 of FIGS. 1–3 and includes a hub 110 and a plurality of radially-extending webs 113 which connect the hub 110 to a radially outer section 114. A wall 115 extending around the periphery of section 114 is interrupted to provide a plurality of exit openings 116 through which blades 118 project. The blades may be identical to the blades of FIGS. 1–3 and have curled inner ends disposed in cylindrical sockets 119 formed in section 114 of the housing. The hub 110 is provided with a frusto-conical end opening 110*a* which is provided with two inwardly-facing flat walls 111. The blades 118 are identical to the blades 40 of FIG. 3 and operate in the same manner, and the portions of the peripheral wall 115 on each side of each exit opening 116 are identical in configuration to the corresponding parts of FIG. 3.

Housing section 108 comprises an end wall 123 formed integrally with a body member 125 which includes a tubular hub 124 and a peripheral wall 126. The body member 125 is substantially identical to the body member 111 except that it is a mirror image of member 111. Also, end wall 123 differs slightly from end wall 109 since wall 123 has a recess 123*a* near its center in place of the frusto-conical drive opening 110*a*.

A drive shaft 130 has an outwardly flared end section 130*a* which engages the inner surface of the end opening 110*a* of housing 107. Two flat sides 130*b* are formed on section 130*a*, which are disposed in flat driving contact with the flat inner walls 111 of the hub 110. The shaft extends through the hubs and receives a nut 132 on a central threaded section of the shaft. The recess 123*a* in end wall 123 is deep enough to receive the nut and, as a result, shaft 130 has an exposed cylindrical section 130*c*, the inner end of which is flush with the face of wall 123 and is adapted to be received in the chuck of a power tool.

When the nut 132 is threaded tightly against the wall, the sections 107 and 108 are locked together and the housing is arranged to be rotated due to the engagement of the flat sides of shaft 130 with the flat walls 111 of section 107. If desired, the shaft may be provided with an end flange arrangement such as the flanges 26*a* and 26*b* of FIG. 4, and the hubs 110 and 124 may be provided with an interconnecting drive arrangement such as is provided on hubs 54 and 66 of FIG. 5.

Figure 10:
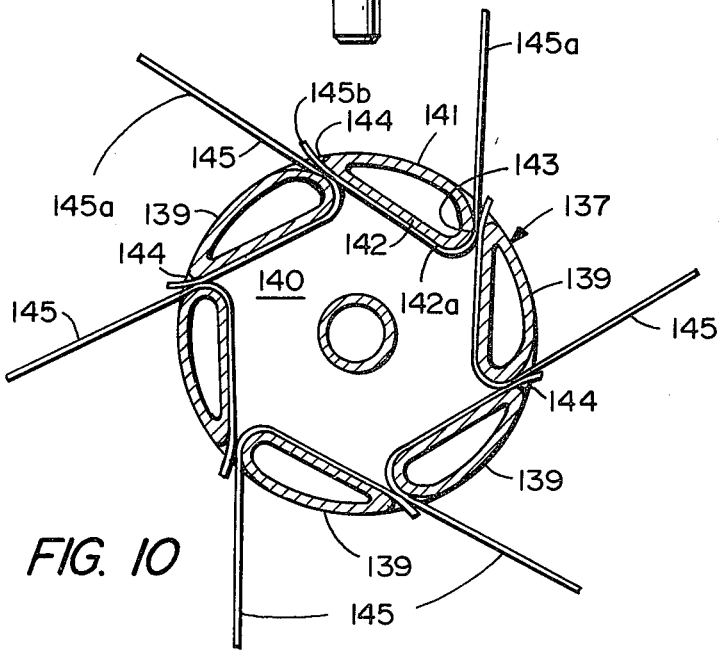
FIG. 10 is a diagrammatic transverse section taken through a fifth embodiment of the present invention

A further embodiment of the stripper of the present invention is illustrated in FIG. 10. This form of the stripper features a unique blade construction wherein each blade has a trailing section that is curved to provide the smooth stress-relieving impact surface provided by the end of arm 43 of FIG. 3. The radial stripper 135 of FIG. 10 is identical to stripper 105 of FIGS. 8 and 9 in that it also has two housing sections each of which includes an end wall integrally formed with a central tubular hub and a body member. The body member and the blades of stripper 135 of FIG. 10 are the only parts of the stripper that differ from corresponding parts of strippr 105 of FIGS. 8 and 9 and therefore only the blades and the body member will be described in detail, it being understood that reference may be had to FIGS. 8 and 9 for details as to the end walls, the center hubs, and the drive shaft connection that is used in stripper 135 of FIG. 10.

In FIG. 10 a view looking in the open end of one of the housing halves of the stripper is illustrated. As in FIG. 9 embodiment, the body member of one section of the housing is generally identical in configuration to the body member of the other housing section but has a mirror image relationship. Accordingly only the body member 137 (FIG. 10) of one housing section will be described in detail.

Each body member includes a plurality of oblong wall members 139 that are formed integrally with and project at right angles away from an end wall 140 of the housing section. Each oblong wall member includes three side sections 141, 142 and 143 connected together to form a closed loop. The sections 141 of the several wall members are formed on a generally cylindrical arc and they cooperate with each other to provide the outer peripheral wall of the housing and to define spaced exit openings 144 in the peripheral wall through which a relatively long arm 145*a* of one blade 145 and a short arm 145*b* of an adjacent blade 145 project. Section 142 of each wall member has a generally flat surface 142*a*.

Section 143 has a curved configuration at the exit opening 144 that corresponds generally to the configuration that the long arm 145*a* of the associated blade assumes when it is snapped back toward wall 141 after impact rebound with a workpiece. As seen in FIG. 10, the section of each blade between the ends 145*a* and 145*b* is relatively straight and lies against the straight side wall section 142*a*.

Each of the blades 145 in the stripper 135 is identical in configuration to each of the others, being made of metallic spring-like material and having a width and thickness within a broad range.

In operation, with the stripper rotating in a clockwise direction (FIG. 10) the ends of blade arms 145*a* engage a workpiece and are flexed back toward the adjacent curved section of wall 143. When it moves out of engagement with the workpiece the arm 145*a* swings clockwise toward the end 145*b* of the next adjacent blade. This end 145*b* is curved in such a manner that it is progressively contacted by the blade arm 145*a* so that the bending stresses are controlled and maintained at a level below the critical fatigue level of the material used.

From the foregoing description it will be apparent that the present invention provides a blade which has, in itself, the means, in the form of a short leading arm, for preventing the buildup of excessive stress in the work-contacting arm during contact with a workpiece. Also, the unique housing and drive arrangements of the present invention provide advantageous, relatively uncomplicated mechanisms for rotary strippers.

I claim:

1. A rotary stripper, comprising:

a generally cylindrical housing which has a plurality of circumferentially spaced pheripheral openings, and which is rotatable in a predetermined angular direction;

a plurality of blades having arm portions projecting through said peripheral openings, each of said blades having a longer work contacting flexing arm and a shorter reaction arm, both composed of springy flexible material, each longer arm having opposite leading and trailing sides, each shorter reaction arm having a trailing surface in confronting relation with said leading side of said longer flexing arm of one of said blades and adapted to be contacted by the last named flexing arm during its forward movement in said direction, said surface of said reaction arm being contoured to yieldingly resist the impact of the confronting longer flexing arm and to limit the stresses set up in said longer arm, to a range which avoids producing fatigue failure in said longer flexing arm upon impact on and rebound from said surface of said reaction arm; and means defining a curved abutment surface on said housing at each of said peripheral openings on said trailing side of each adjacent longer flexing arm in position to be contacted by said flexing arm during its rearward movement upon contact with a work surface, said abutment surface being contoured to progressively engage said flexing arm to limit the stresses set up therein upon contact with and rebound from said abutment surface, to a range of stress which will avoid producing fatigue failure in said longer flexing arm during impact with said abutment surface and rebound therefrom.

2. A rotary stripper as defined in claim 1, wherein said housing has a body formed symmetrically around a central axis; wherein said peripheral openings define a plurality of sockets in said body spaced equi-angularly around said axis, with spaced walls defining a passage leading from each socket to one of said peripheral openings;

wherein each of said blades has a curved inner portion engaged in one of said sockets; and wherein said flexing arm and reaction arm of each of said blades extend through said passage, each flexing arm being longer than said reaction arm so that each flexing arm has a free outer end adapted to be moved into engagement with said work for stripping material therefrom during rotation of said body on said axis.

3. A rotary stripper as defined in claim 2, wherein said body comprises a pair of housing sections, each of said sections having:

an end wall, a central hub with an axial bore therethrough, and a generally cylindrical outer wall spaced radially from said hub;

said sockets being disposed equi-angularly around each of said hubs and communicating with said peripheral openings respectively via passages extending between each socket and each of said openings;

wherein several of said blades are disposed in side-by-side relationship axially of said housing in each of said sockets;

wherein said housing sections are mirror images of each other and are adapted to be positioned in axial alignment with said end walls in abutting relationship to define said housing; and means for securing said housing sections together with said sockets, passages and hub in one of said sections in registration with said sockets, hubs, and passages respectively in the other of said sections.

4. A rotary stripper as defined in claim 3, wherein said means for securing said sections together comprises a drive shaft extending through said central bores in said registring hubs in both of said housing sections.

5. A rotary stripper as defined in claim 4, wherein said axial bore in each of said hubs has a cross section presenting first abutment walls, said shaft having another cross section approximately equal to said cross section of said bore, and having other abutment walls which may be juxtaposed to said first abutment walls for rotating said housing.

6. A rotary stripper as defined in claim 3, further comprising means for rotating said housing and comprising interdigitating members on said hubs of said housing sections, so that rotation of one of said sections effects joint rotation of both of said sections.

7. A rotary stripper as defined in claim 3, wherein one of said housing sections has a central drive socket having a predetermined cross section; and wherein said means for securing said sections together comprises a drive shaft having a shaft portion formed with a peripheral drive collar having a cross section which is substantially the same as said cross section of said drive socket, said shaft and said drive socket having mutually abutting circumferential walls defining means for rotationally driving said housing by said shaft.

8. A rotary stripper as defined in claim 7, wherein said shaft has a shank extending axially outward from said shaft portion and said housing, and arranged to be engaged by a mechanical power drive mechanism for rotationally driving said housing.

9. A rotary stripper as defined in claim 3, wherein said one housing section has an external other end wall formed with a portion defining a deep recess extending axially inward of said one housing section, and wherein said means for securing said housing sections together, comprises:

a drive shaft extending through said hubs and into said recess, a retainer member carried by said shaft and disposed at an external other wall of said other housing section; and a nut threaded on said shaft and located in said recess, so that rotation of said nut is effective to draw said retainer member into abutting contact with said other end wall of said other housing section to hold said housing sections together.

10. A rotary stripper as defined in claim 3, wherein said hub in said one housing section has a tapered end portion;

wherein said bore in said hub of said one housing section has at one end thereof a flat wall area inside said tapered end portion;

wherein said hub in said other housing section has at one end thereof a central recess; and wherein said means for securing said housing sections together comprises:

a drive shaft extending through said bores in both of said housing sections, said drive shaft having a tapered end portion with flat drive area thereon, and a nut threaded on said shaft and disposed in said recess for drawing said tapered end portion of said shaft axially into said tapered portion of said hub in said one housing section, and to bring said flat drive area of said shaft alongside said flat wall area of said bore in said hub of said one housing section.

11. A rotary stripper as defined in claim 1, wherein said flexing arm of each of said blades projects through one of said peripheral openings at the leading side of the blade, while said reaction of of the same blade projects through the next peripheral opening beyond the trailing side of said one peripheral opening to confront therein the next flexing arm at the leading side of the next blade.

12. A rotary stripper as defined in claim 11, further comprising a plurality of circumferentially spaced internal walls having straight guide surfaces disposed inwardly of said cylindrical housing, each of said blades having a relatively flat section between said flexing and reaction arms of that blade disposed in abutment with said straight guide surface of each of said internal walls.

13. A rotary stripper comprising:

a pair of generally cylindrical housing sections, each section comprising a circular end plate and a plurality of wall members secured to and projecting at right angles away from said plate, said wall members being disposed around the periphery of said end plate to provide spaces between adjacent wall members defining circumferentially spaced peripheral openings;

means connected to said housing sections to drive them in a predetermined rotational direction; and a plurality of blades carried by each of said housing sections, each of said blades having a first arm extending through one of said peripheral openings and having an outer end adapted to engage a work surface, and a second arm projecting through said one peripheral opening on the leading side of said one opening, said second arm having a curved surface confronting said first arm and being contoured to limit the stress set up in said first arm as it contacts and rebounds from said curved surface to a range that will avoid producing fatigue failure from repeated contact therewith.

14. A rotary stripper as defined in claim 13, wherein each of said wall members has a partially cylindrical surface defining a portion of the outer wall of said cylindrical housing section and a relatively straight guide surface disposed inwardly from said cylindrical surface, each of said blades having a relatively flat section disposed against said straight guide surface of said wall member.

15. A rotary stripper as defined in claim 13, wherein each of said wall members includes a curved abutment section disposed on the trailing side of each peripheral opening in confronting relation with each adjacent first arm, said abutment section being contoured to limit the stress set up in said adjacent first arm during repeated flexing to a range that will avoid producing fatigue failure in said first arm.

* * * * *